United States Patent [19]

Sandstrom

[11] 4,206,779

[45] Jun. 10, 1980

[54] WATER LINE TERMINATOR

[76] Inventor: Wayne R. Sandstrom, Box 2414, Fairbanks, Ak. 99707

[21] Appl. No.: 891,264

[22] Filed: Mar. 29, 1978

[51] Int. Cl.[2] ..... F16L 5/00

[52] U.S. Cl. ..... 137/360; 137/207

[58] Field of Search ..... 137/360, 362, 207

[56] References Cited

U.S. PATENT DOCUMENTS

| | | | |
|---|---|---|---|
| 185,645 | 12/1876 | Pennie | 137/360 |
| 3,003,659 | 10/1961 | Miller | 137/207 |
| 3,024,799 | 3/1962 | Flieder | 137/207 |
| 3,331,386 | 7/1967 | Politz | 137/360 |
| 3,565,338 | 6/1969 | Wright | 137/207 |

FOREIGN PATENT DOCUMENTS

| | | | |
|---|---|---|---|
| 615776 | 3/1961 | Canada | 137/207 |

*Primary Examiner*—Martin P. Schwadron
*Assistant Examiner*—A. Michael Chambers
*Attorney, Agent, or Firm*—Bacon & Thomas

[57] ABSTRACT

A fixture for attachment to water lines during installation of plumbing in a building under construction. A closed chamber has a base flange for attachment to a suitable support and a water inlet tube near the base. An outlet tube extends in the chamber from a position near the base and through the other end where it is provided with a valve. The tubes are so arranged in the chamber that the fixture can be installed in either a horizontal or a vertical position and yet trap a body of air in the chamber when supplied with water.

2 Claims, 3 Drawing Figures

Fig. 1.
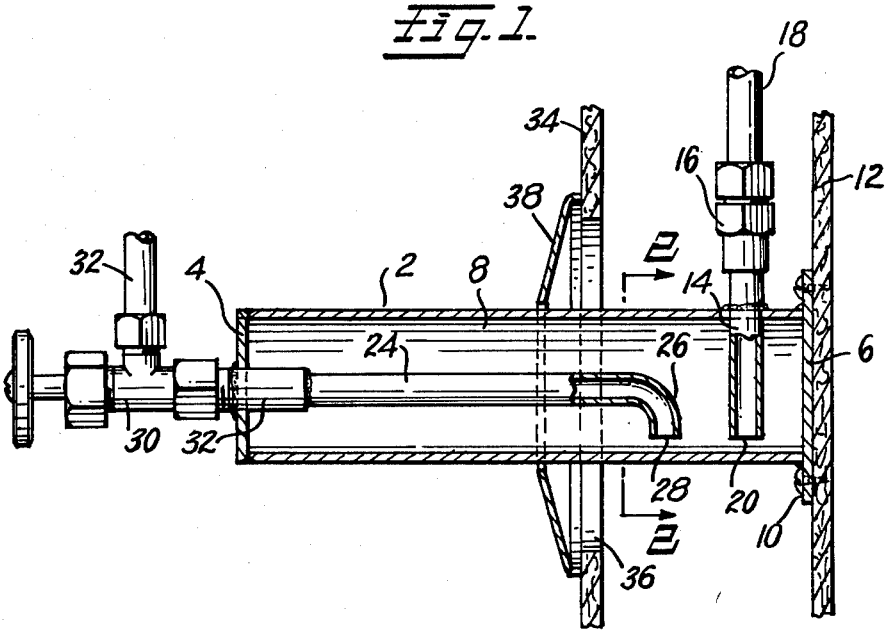
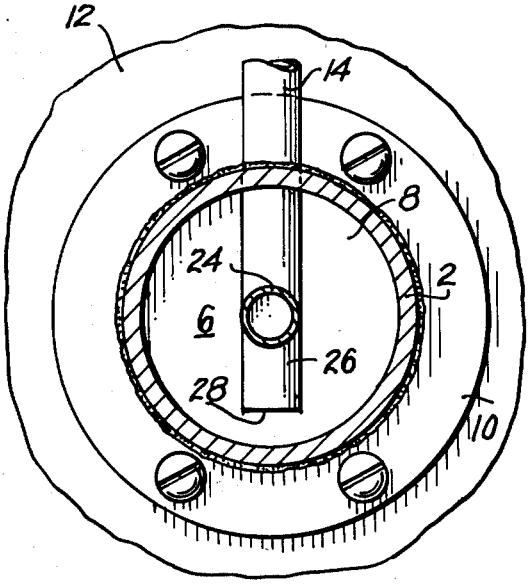
Fig. 2.
Fig. 3.
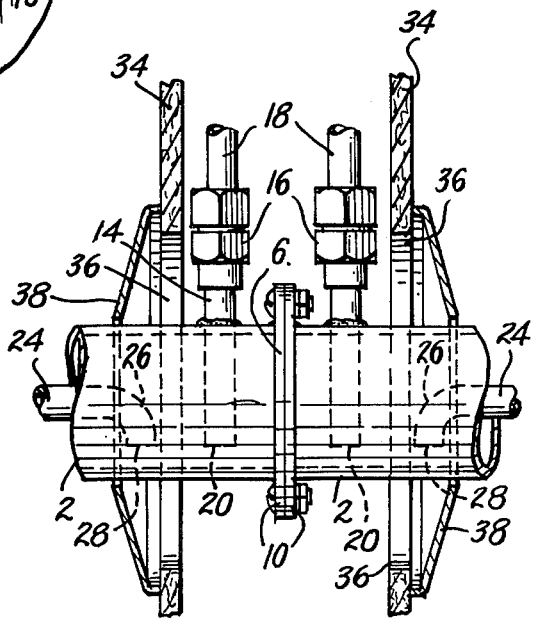

WATER LINE TERMINATOR

BACKGROUND OF THE INVENTION

This invention is in the field of plumbing devices for installation during building construction.

In constructing buildings having water pipes therein, it has been customary to first erect the framework of walls or the like, then install the water pipes to be ultimately concealed within the finished wall. At the locations where water service is to be provided in the building, it has been customary to install nipples or tubing from the piping to extend outwardly therefrom and which nipples were customarily capped until construction of the building was completed. Then, to install the fixtures it was necessary to uncap the nipples and often to cut and rethread them for proper connection to the fixtures to be installed. Such practice is time-consuming and expensive and often results in the waste of considerable material.

SUMMARY OF THE INVENTION

The present invention provides a fixture that can be connected to the water pipes to be concealed within the wall, during construction of the building, and which will not be modified upon completion of the wall. The fixture is adapted to be connected directly to the fixture to be served by the water line, without modification, and further provides for trapping a body of air in the water line to eliminate water "hammer" and to permit testing or draining of the lines before the building is complete.

In general, the invention comprises a tubular cylindrical chamber having an inlet tube adapted to be connected to the water pipe in the framing, which tube extends into the cylindrical chamber to an outlet end adjacent one side and adjacent one end thereof. An outlet or delivery tube extends axially of the chamber to a position close to the inner end of the inlet tube and is provided with a stop cock or valve at its outer end. The device is also provided with suitable brackets or flange means by which it may be mounted to a support surface of the building or mounted in back-to-back relation to a similar device. Upon completion of the wall, it is only necessary to apply a suitable escutcheon plate over the device and connect the service fixture to the outlet of the stop cock or valve.

BRIEF DESCRIPTION OF THE DRAWINGS

FIG. 1 is a vertical sectional view, with parts shown in elevation, of the subject of this invention showing its manner of installation in a wall;

FIG. 2 is a transverse vertical sectional view, on an enlarged scale, taken along the line 2—2 of FIG. 1; and FIG. 3 is a fragmentary illustration showing an alternative manner of installing the device.

DESCRIPTION OF THE PREFERRED EMBODIMENT

As shown in the drawings, the device of the present invention, which can be called a water line terminator, comprises a generally cylindrical tubular structure 2 which may be of any suitable metal, plastic or other material having ends 4 and 6 sealingly secured thereto to define a closed chamber 8. The end 6, for example, extends outwardly beyond the tubular body 2 to define a mounting flange 10 provided with openings therein by which the device may be mounted to any suitable support 12 during construction of a building. An inlet tube 14 extends through a side wall of the tubular casing 2 and is sealed thereto in a water-tight manner. The inlet tube may be provided with connector or coupling means 16 by which it may be connected to a water pipe 18 installed in the building during the framing thereof. The inlet tube 14 extends generally diametrically across the interior of the casing 2 adjacent the end 6 and to an outlet end 20 close to the opposite or lower wall of the casing, all as clearly shown in FIG. 1. The other end 4 of the casing 2 is provided with a central opening in which a suitable nipple 22 is sealed and to which an outlet tube 24 is connected to extend rearwardly to a position adjacent the end 6 of the device. The inner end of the outlet tube 24 is shown as being curved downwardly at 26 to an inlet end 28 adjacent the inlet tube 14 and also close to the lower wall of the casing 2.

At its outer end, the nipple 22 may be provided with suitable threads on which a stop cock or valve 30 is mounted. Numeral 32 indicates a line leading to a water-using fixture, which tubing or line will be installed later and which is not a part of the present invention itself. While FIG. 1 shows a valve 30 having a lateral outlet, it is obvious that any suitable valve may be employed to accommodate whatever water-using fixture is to be installed.

In FIG. 1, numeral 12 represents any suitable support present during the framing of the building. When the device is installed as illustrated in FIG. 1, the inner wall 34 will not be present but will be installed thereafter and provided with a suitable opening 36 surrounding the structure just described. After completion of the wall 34, any suitable escutcheon plate, such as 38, may be slipped over the casing 2 to conceal the opening 36, all as well known, and thereafter the line 32 leading to the fixture may be mounted and the water-using appliance itself installed in place.

Even before completion of the wall 34 and installation of the appliance, water may be introduced into the plumbing of the building to test the system for leaks or the like. Obviously, the valve 30 at this time may be closed to prevent loss of water and opened at any time for testing, draining the system or the like.

As will be obvious, after the device is installed as shown, and water introduced through piping 18, a body of air will be trapped in the upper portion of the casing 2 to serve as a surge chamber an to eliminate the "hammer", all as is well known. While the device is shown installed in a horizontal position to extend outwardly from a vertical wall, it will be obvious that it may be installed in a vertical position to extend upwardly through a floor. In the latter case, the ends 20 and 29 of the tubing described will be both adjacent the bottom of the chamber and thus a body of air will be trapped for the described purposes even with the vertical installation referred to.

FIG. 3 illustrates an alternative form of mounting wherein the bases 6 of duplicate devices are mounted on each other to extend through opposite surfaces of a dividing wall into adjacent rooms. In this instance, the flanges 10 are merely bolted to each other rather than to any fixed support constituting a part of the building and the advantages of the invention are thus achieved in a simple and economical manner.

While the casing 2 is shown as a length of cylindrical tubing having the ends 4 and 6 separately secured thereto, it is to be understood that the device could be fabricated with integral end walls, such as by spinning or casting the same.

While a single specific embodiment of the invention has been shown herein, the same is not intended to limit the scope of applicant's invention, which is to be limited only by the scope of the appended claims.

I claim:

1. A water line terminator comprising:

walls defining a closed and generally cylindrical chamber having a cylindrical wall, end walls and a radial flange at one end wall thereof for mounting said chamber on a support;

an inlet tube extending generally radially into one side of said cylindrical wall said chamber adjacent said one end and across the interior of said chamber to an inner end terminating adjacent but spaced from the other side of said cylindrical wall;

an outlet tube extending axially within said chamber from an inner open end adjacent, the inner end of said inlet tube and extending axially through the other end wall of said chamber; and manually operable valve means on said outlet tube outwardly of said other end.

2. A water line terminator as defined in claim 1 wherein said valve means lies within the axially projected outline of said chamber whereby an escutcheon plate may be passed over said valve means and onto said chamber.

* * * * *